US008733893B2

(12) United States Patent
Arthur et al.

(10) Patent No.: US 8,733,893 B2
(45) Date of Patent: May 27, 2014

(54) MULTI-MEMBER, NESTED PRINTHEAD

(75) Inventors: Alan R. Arthur, Salem, OR (US); Bradley D. Chung, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 181 days.

(21) Appl. No.: 13/194,491

(22) Filed: Jul. 29, 2011

(65) Prior Publication Data

US 2013/0027467 A1 Jan. 31, 2013

(51) Int. Cl.
*B41J 2/14* (2006.01)

(52) U.S. Cl.
USPC ..... 347/40; 347/47

(58) Field of Classification Search
USPC ..... 347/40, 43, 47, 64, 65
See application file for complete search history.

(56) References Cited

U.S. PATENT DOCUMENTS

| | | | | |
|---|---|---|---|---|
| 5,434,745 | A | 7/1995 | Shokrgozar et al. | |
| 7,018,503 | B2 | 3/2006 | Murthy et al. | |
| 7,658,470 | B1 | 2/2010 | Jones et al. | |
| 7,690,776 | B2 | 4/2010 | DeVore et al. | |
| 8,328,334 | B2 * | 12/2012 | Xie et al. | 347/54 |
| 2011/0001786 | A1 | 1/2011 | Doran et al. | |
| 2011/0037159 | A1 | 2/2011 | Mcelrea et al. | |

* cited by examiner

*Primary Examiner* — Lamson Nguyen

(57) ABSTRACT

A printhead comprises a first member and a second member, formed separately from the first member. The second member is nested within a first space defined by the first member. A plurality of fluidic transmission channels is formed between the first and second members to convey ink to an outer surface of the first and second members.

19 Claims, 14 Drawing Sheets

MULTI-MEMBER, NESTED PRINTHEAD

BACKGROUND

A common way to form images on media, such as paper, is to use a fluid-ejection device, such as an inkjet printer. An inkjet printer includes a number of components including a printhead which causes ink to be ejected from reservoirs one drop at a time on to the medium. One of the components of the printhead is a subassembly that includes multiple channels for the ink to flow from the ink reservoirs to a die that causes the ink droplets to be ejected on to the medium. The manufacturing of such subassemblies is such that it is difficult to make the channels through which the ink flows as narrow as may be desired or to have a pitch (inter-channel spacing) that is as small as may be desired. Flashing from injected molding the subassemblies may also be a problem. Smaller dimensions may be desired to make smaller printheads, for example, for lower cost.

BRIEF DESCRIPTION OF THE DRAWINGS

For a detailed description of exemplary implementations, reference will now be made to the accompanying drawings in which.

NOTATION AND NOMENCLATURE

Certain terms are used throughout the following description and claims to refer to particular system components. As one skilled in the art will appreciate, each company may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct or through an indirect connection via another device.

DETAILED DESCRIPTION

Various implementations are disclosed herein related to a printhead that includes a fluid routing assembly that enables fluid (e.g., ink) to be routed from a reservoir to a die on printhead. The fluid routing assembly comprises multiple pieces that are nested one within a space defined by another in such a way that fluid transmission channels are formed by engineered gaps created between the various pieces. The pieces are assembled together by, for example, adhesive or welding. By assembling the fluid routing assembly out of multiple, separately formed pieces, the gaps between the various pieces can be tightly controlled and may be smaller than would otherwise be possible from a fluid routing assembly made from a single piece with channels formed during manufacturing of the single piece. Smaller printhead assemblies are thus possible based on the embodiments described herein.

Figure 1:
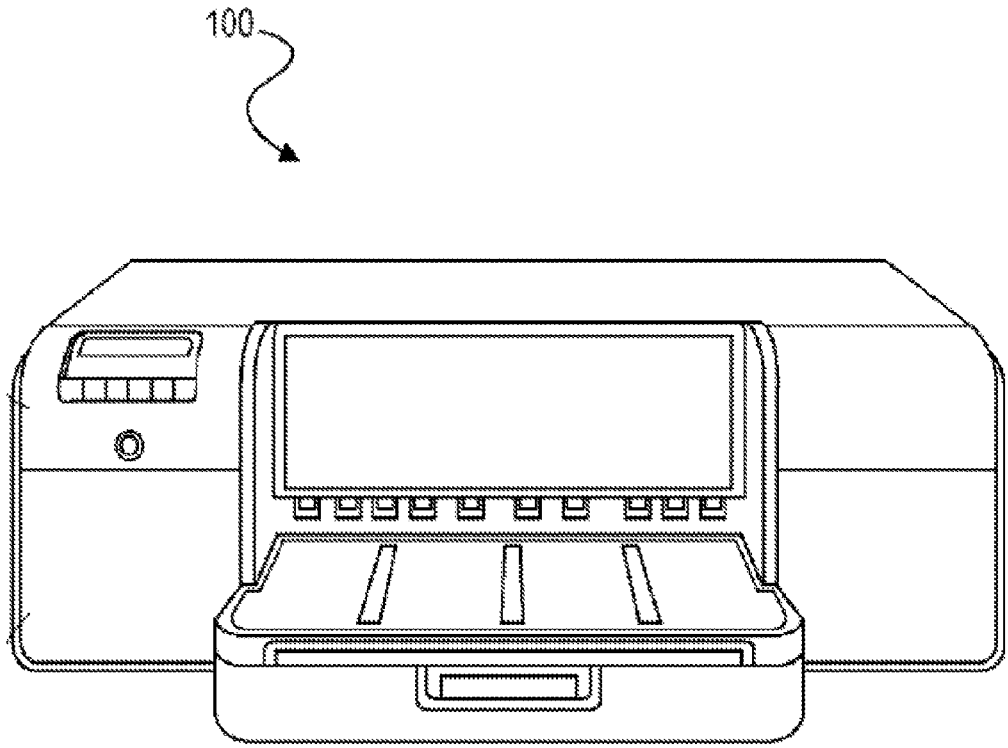
FIG. 1 shows a printer in accordance with various implementations.

FIG. 1 shows a representative printer 100, according to an embodiment of the present disclosure. In some embodiments, the printer is an inkjet-printer. As such, the printer 100 ejects a fluid (e.g., ink) onto print media, such as paper, to form images on the media. The printer 100 of FIG. 1 comprises a print media tray 106 in which print media such as paper is stored pending its use in printing images.

Figure 2:
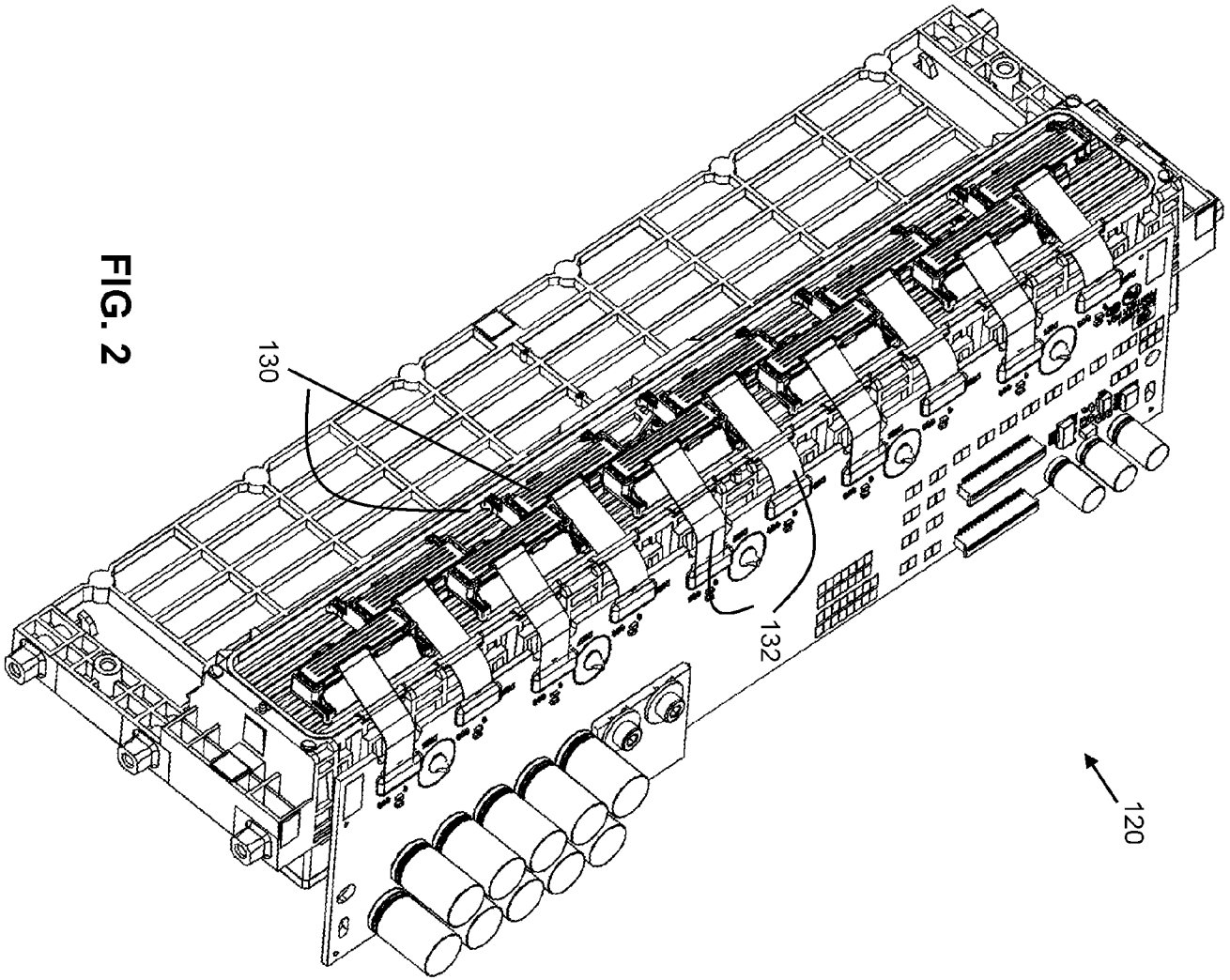
FIG. 2 shows a printhead in accordance with various implementations.

The printer 100 comprises multiple other components such as at least one printhead. A variety of embodiments are possible for the printhead. FIG. 2 shows one such illustrative embodiment of a printhead 120. As shown, printhead 120 comprises multiple printhead subassemblies 130. In the example of FIG. 2, the printhead 120 comprises 10 printhead subassemblies 130, but in general, the printhead can have any suitable number of printhead subassemblies (i.e., one or more).

Each printhead subassembly 130 comprises a fluid routing assembly and a die. Each die receives electrical signals via a flexible cable 132 and causes appropriate amounts of specific colors of ink to be ejected from the printhead 130 onto the print medium as print media pass by the printhead from the print media tray 106.

Figure 3:
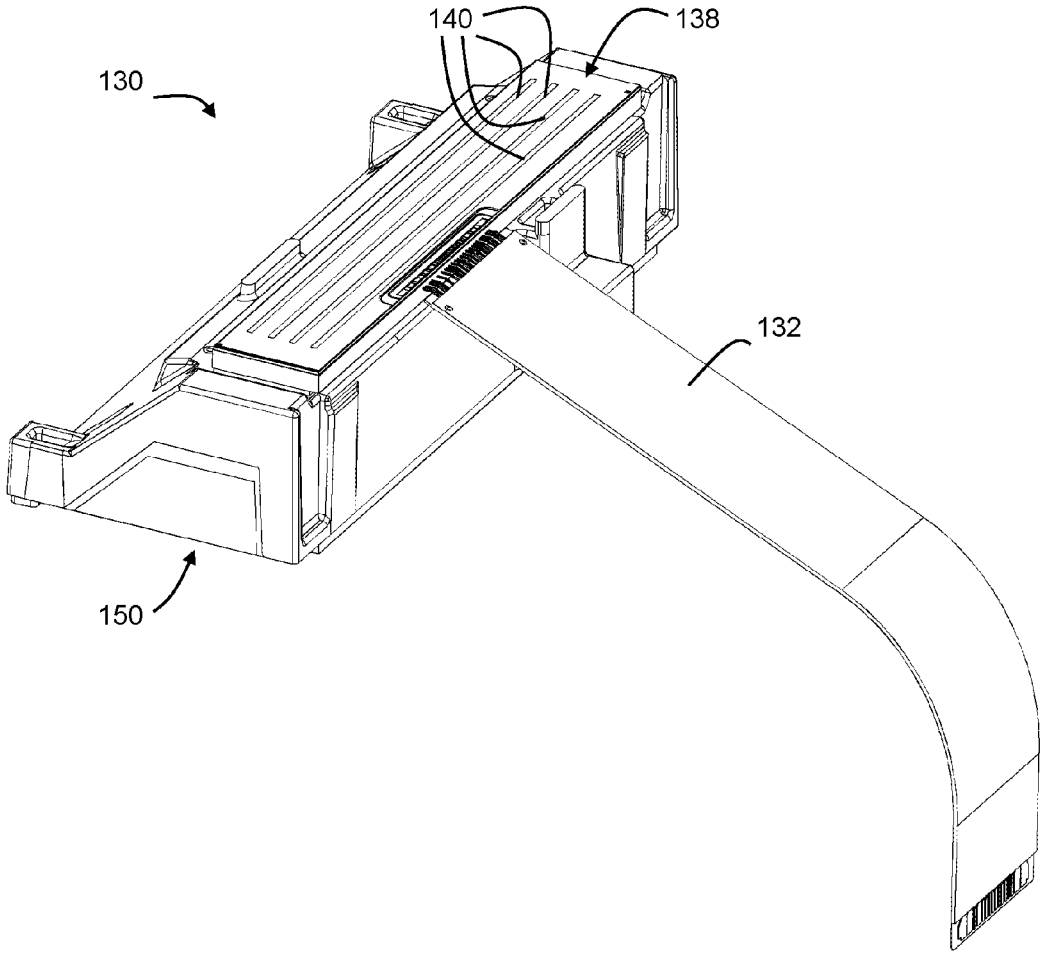
FIG. 3 shows a printhead subassembly in accordance with various implementations.

FIG. 3 illustrates a printhead subassembly 130 in accordance with at least one embodiment. As shown, the printhead subassembly 130 comprises a die 138 attached to an outer surface of a fluid routing assembly 150. A flexible electrical cable 132 is also shown that provides electrical connectivity to die 138. The flexible electrical cable 132 permits the die to be electrically connected to control circuitry in the printer. Slots 140 in the die 138 permit fluid, such as ink, to flow from routing assembly 150 to the orifice plate (not shown), where it is ejected as droplets onto the media from the print media tray 106.

Figure 4:
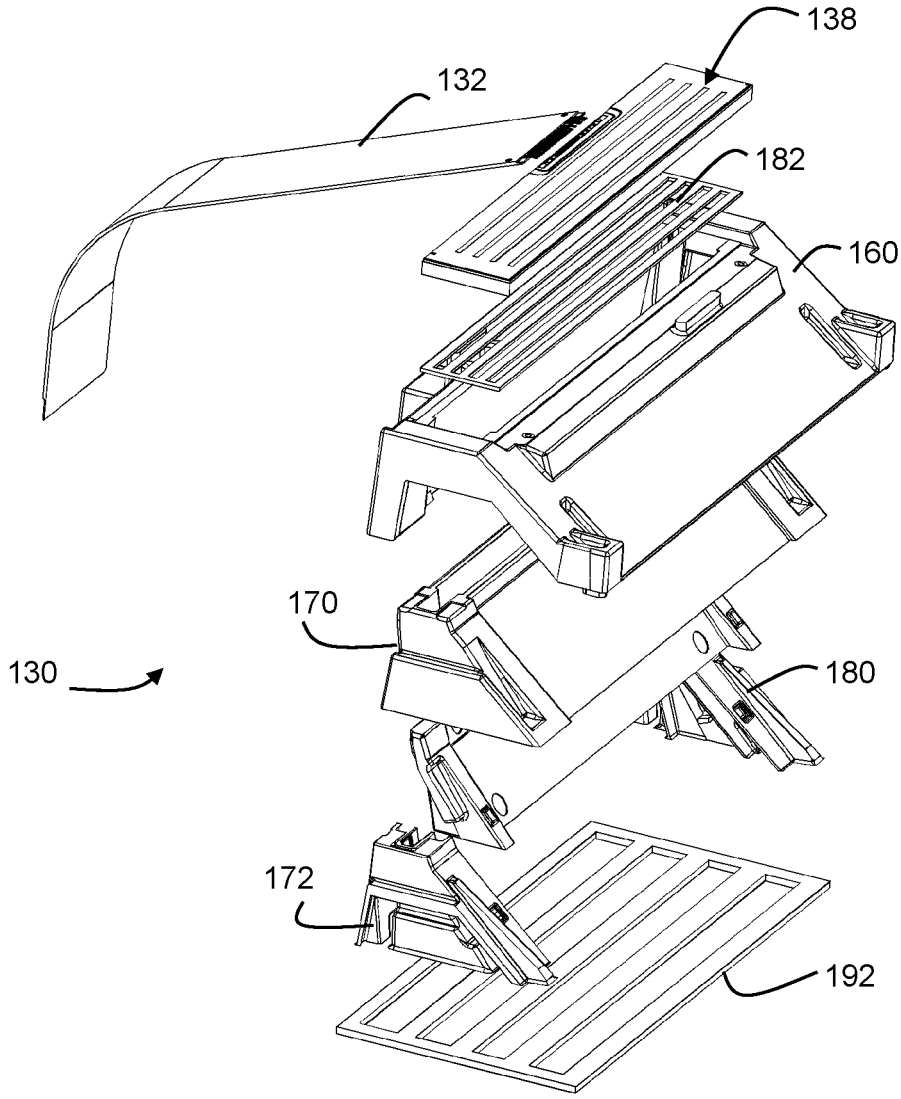
FIGS. 4-6 show various exploded views of the printhead subassembly of FIG. 3 accordance with various implementations.

FIG. 4 shows an exploded view of the printhead subassembly 130. The flexible electrical cable 132 is shown connected to the die 138. The structural components of the printhead subassembly 130 include an outer member 160, a middle member 170, and an inner member 180. The outer, middle, and inner members 160, 170, and 180 fit together in a nested fashion. As will be shown better in other figures and discussed below, with the members 160-180 assembled together, fluidic transmission channels are defined between the adjacent surfaces of the various members 160, 170, 180 to permit fluid (e.g., printer ink) to flow to and through the die 138 and to the orifice plate. The outer, middle, and inner members 160, 170, and 180 are formed separately from each other and the fluidic channels are formed by the relative placement of the various members during assembly. The fluidic channels therefore do not need to be defined by extremely narrow blades during molding. As such, the fluidic channels can be narrower and have a smaller pitch than would otherwise be possible if the subassembly was formed from a single unitary block of material with fluidic channels being defined directly by narrow blades during the manufacturing process. Because blades are not used to create the fluidic channels, flashing is less of a problem or may be completely eliminated.

In some embodiments, the outer, middle, and inner members 160, 170, and 180 are made of plastic. However, in other embodiments, the members 160, 170, and 180 comprise a die cast material (e.g., aluminum, zinc, and magnesium). In yet other embodiments, the members 160, 170, and 180 comprise a ceramic.

In the embodiment shown in FIG. 4, the die 138 and outer, middle, and inner members 160, 170, and 180 are held together by way of adhesive. Adhesive 182 is shown to adhere die 138 to members 160, 170, and 180. Adhesive 172 is provided on both ends of the printhead subassembly 130 to adhere the outer, middle, and inner members 160, 170, and 180 together to form a complete fluid routing assembly. Adhesive 192 is used to attach the printhead subassembly 130 to the rest of the printhead as illustrated in FIG. 1. Any suitable adhesive such as an epoxy or cyanoacrylate can be used. The adhesives 172, 182, and 192 may comprise a wicking adhesive that fills in engineered gaps between the various members 160, 170, and 180. As such, the shape of adhesive 172 represents the resulting shape of that adhesive after it wicks into the gaps on the ends of the printhead subassembly 130.

Figure 5:
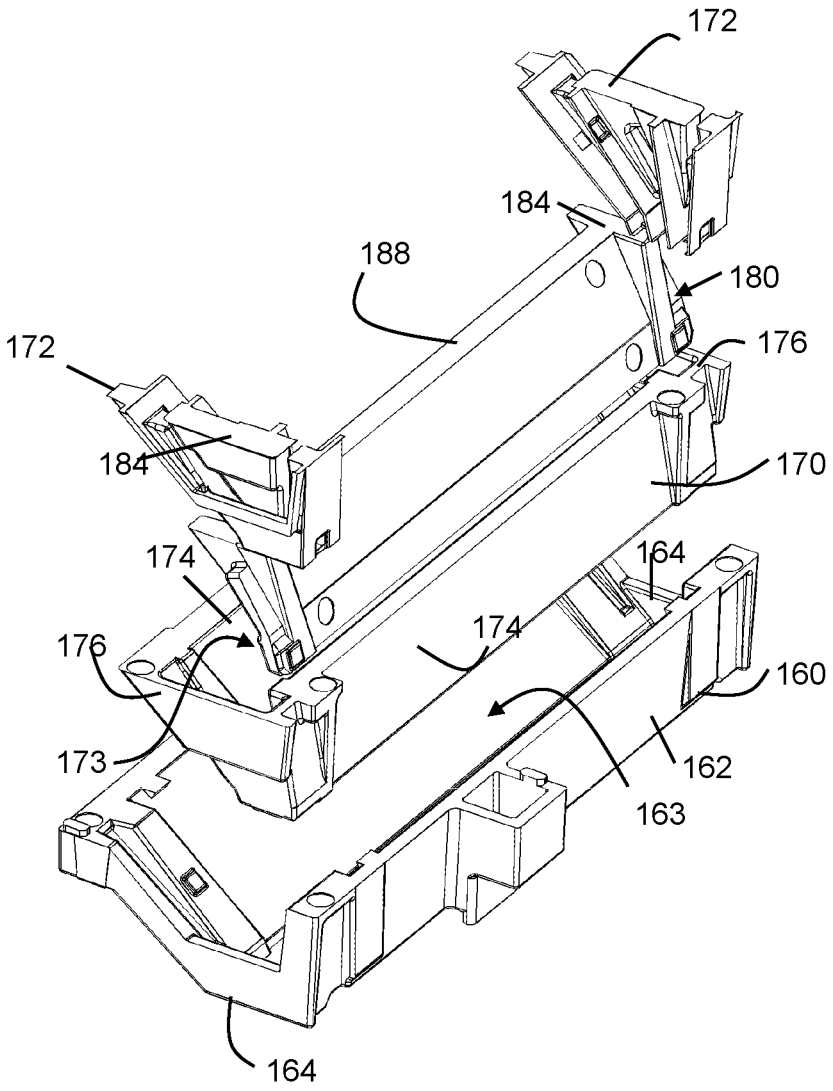

FIG. 5 illustrates an exploded view of the printhead subassembly 130 from the bottom (opposite side from where the orifice plate 138 attaches). The middle member 170 is nested within a space 163 defined by the outer member 160. The inner member 180 is nested with a space 173 defined by the middle member 170.

In at least some embodiments, outer member 160 comprises a pair of angled parallel sides 162 connected together by way of end caps 164. That the sides 162 are "angled" refers to the orientation of the sides inward toward each other in a V-shape. In some embodiments, sides 162 are non-parallel. In some embodiments, outer member 160 is formed as one unitary member, but in other embodiments, outer member 160 may be formed as separate pieces 162 and 164 which are then attached together via, for example, adhesive or welding.

Middle member 170 also comprises a pair of angled parallel sides 174 connected together by way of end caps 176. In some embodiments, sides 174 are non-parallel. In some embodiments, middle member 170 is formed as one unitary member, but in other embodiments, middle member 170 may be formed as separate pieces 174 and 176 which are then attached together via, for example, adhesive or welding. The distance separating the sides 174 is less than the corresponding distance separating sides 162 of outer member 160.

In the embodiment of FIG. 5 inner member 180 comprises a single longitudinal bar 188 with end caps 184 on either end of the bar. In some embodiments, inner member 180 is formed as one unitary member, but in other embodiments, inner member 180 may be formed as separate pieces 184, 188 which are then attached together via, for example, adhesive or welding. The end caps 184 may be triangular-shaped as shown or comprise other shapes as desired.

Figure 6:
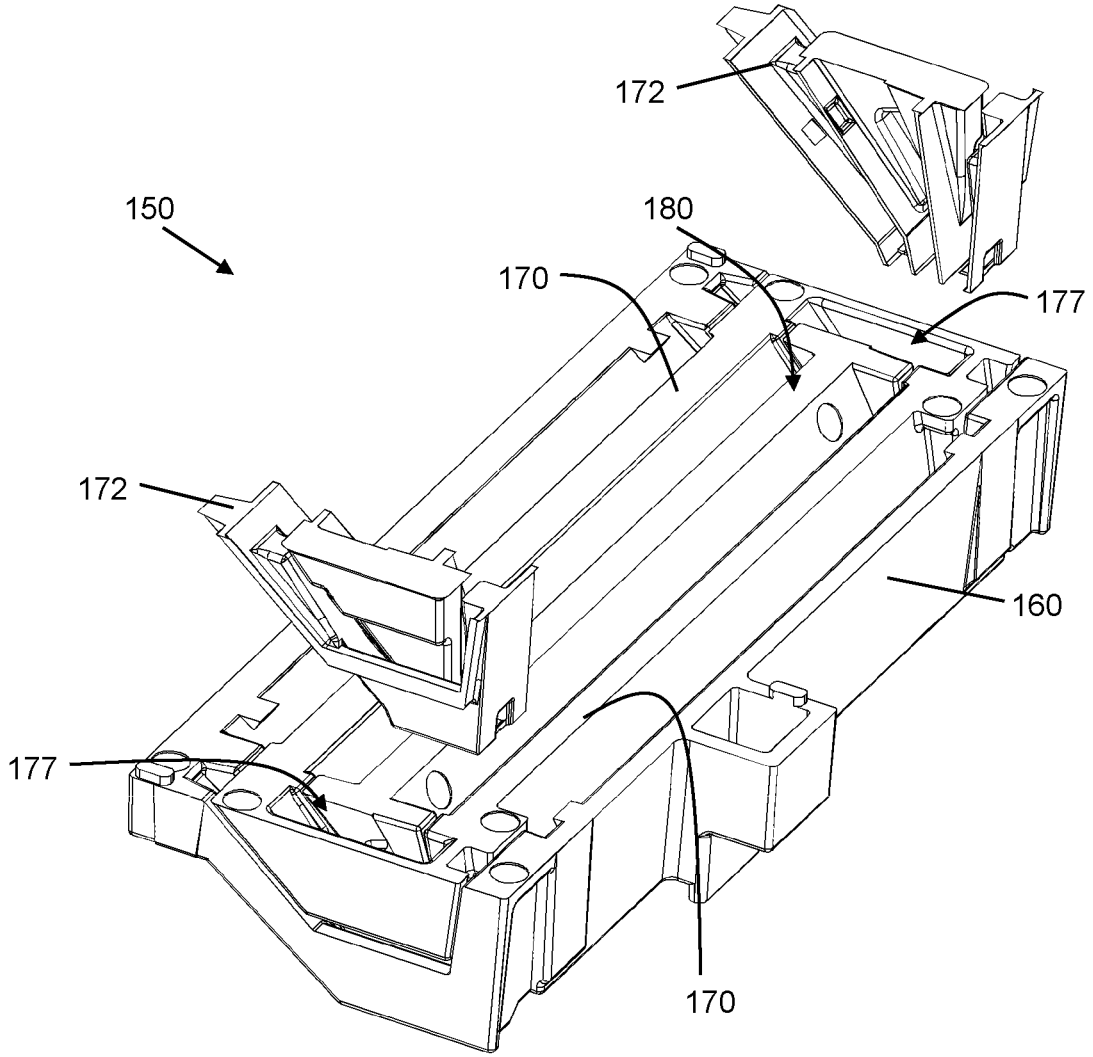

FIG. 6 illustrates the outer, middle, and inner members 160, 170, 180 nested together. The nested relationship of members 160, 170, and 180 means that one member partially or fully resides within a volume of space defined by another member. With inner member 180 nested within middle member 170 and middle member nested within outer member 180, inner member 180 is also nested within a space defined by the outer member 160. Thus, inner member 180 is nested within both the middle and outer members 170 and 160. As can be seen in FIG. 6, adhesive 172 is dispensed into end wells 177 formed at opposing ends of the fluid routing assembly 150 by the shape and spacing of the various members 160, 170, and 180.

Figure 7:
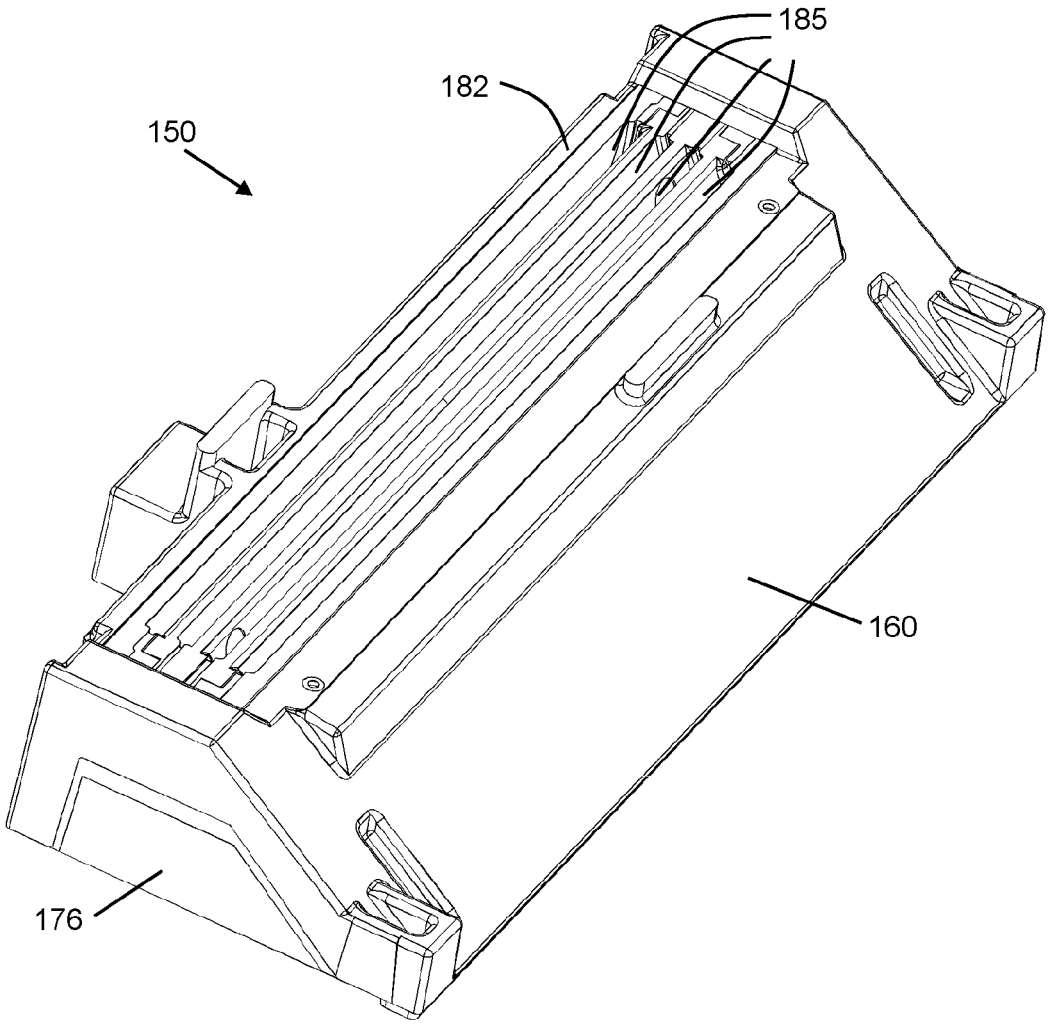
FIGS. 7 and 8 show views of an assembled printhead subassembly in accordance with various implementations.

FIG. 7 shows an assembled fluid routing assembly 150. The slots 185 correspond to the fluidic channels formed in the fluid routing assembly 150 through which the liquid is to flow and permit the fluid to flow through the adhesive layer to the die. FIG. 7 also shows an end cap 176 of the middle member 170. As shown, end cap 176 has a shape that fits within a correspondingly shaped area of the outer member 160.

Figure 8:
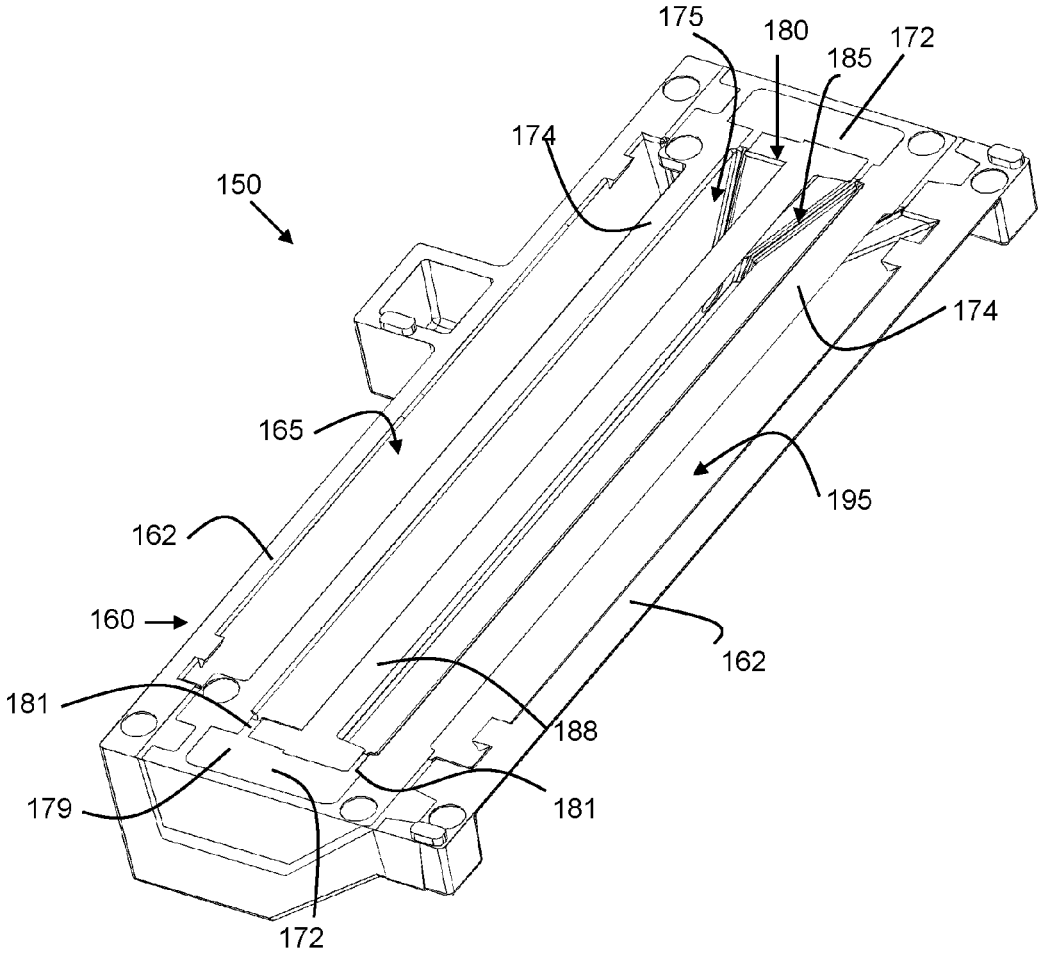

FIG. 8 shows a view of the assembled fluid routing assembly 150 similar to the view of FIG. 6 but with the adhesive 172 in place on the ends of the outer, middle, and inner members 160, 170, and 180. As can be seen, the adhesive 172 wicks into the gaps formed between adjacent surfaces of the members 160, 170, and 180. The cross-sectional shape of the adhesive 172, once wicked into the gaps is one of a generally longitudinal portion 179 with side extensions 181 that protrude out from the longitudinal portion 179 at approximately right angles into the engineered gaps between the members 160, 170, and 180.

FIG. 8 also illustrates the fluidic transmission channels that are formed upon assembly of the outer, middle, and inner members 160, 170, and 180. Fluidic transmission channels 165 and 195 are formed on opposite sides of the fluid routing assembly 150 between the outer member 160 and middle member 170. Fluidic transmission channels 175 and 185 are formed on either side of inner member 180 and between the inner member 180 and middle member 170. In the embodiment of FIG. 8, the angled, sides 162 and 174 of outer and middle members 160 and 170 and the longitudinal bar 188 of the inner member 180 comprise five longitudinal and spaced apart structures that form four fluidic channels 165, 175, 185, and 195 as shown. In other embodiments, a different number of fluidic transmission channels can be provided by providing a different number of nested members (i.e., different than three). For example, a fluid routing assembly having six fluidic channels can be provided. Each fluidic channel is adapted to receive a fluid (e.g., an ink). In the case of inks, the ink in each fluidic channel can be the same or different inks (e.g., different colors) can be used.

Figure 9:
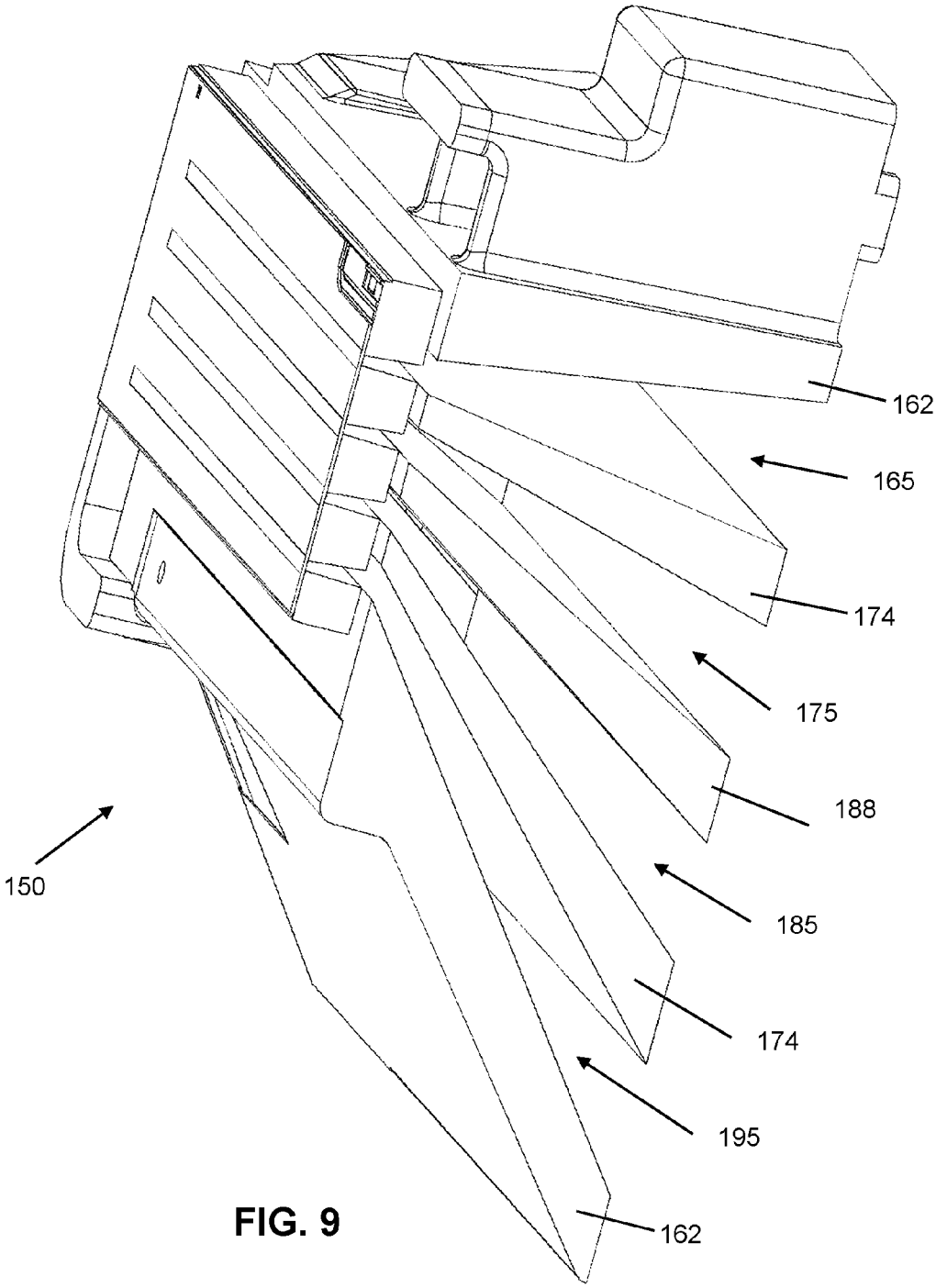
FIG. 9 shows a cutaway view of the printhead subassembly of FIGS. 3-8 in accordance with various implementations.

FIG. 9 shows a side cut-away view of the fluid routing assembly 150. The various fluidic channels 165, 175, 185, and 195 are shown extending downward from the die 138 at various angles. As shown and as discussed above with regard to other figures, the inner member 180 nests within a space defined by the two angled sides 174 of the middle member 170, and the middle member 170 resides with a space defined by the two angled sides 162 of the outer member 160. Thus, the inner member 180 resides within the middle member 170 which in turn resides within the outer member 160.

Figure 10:
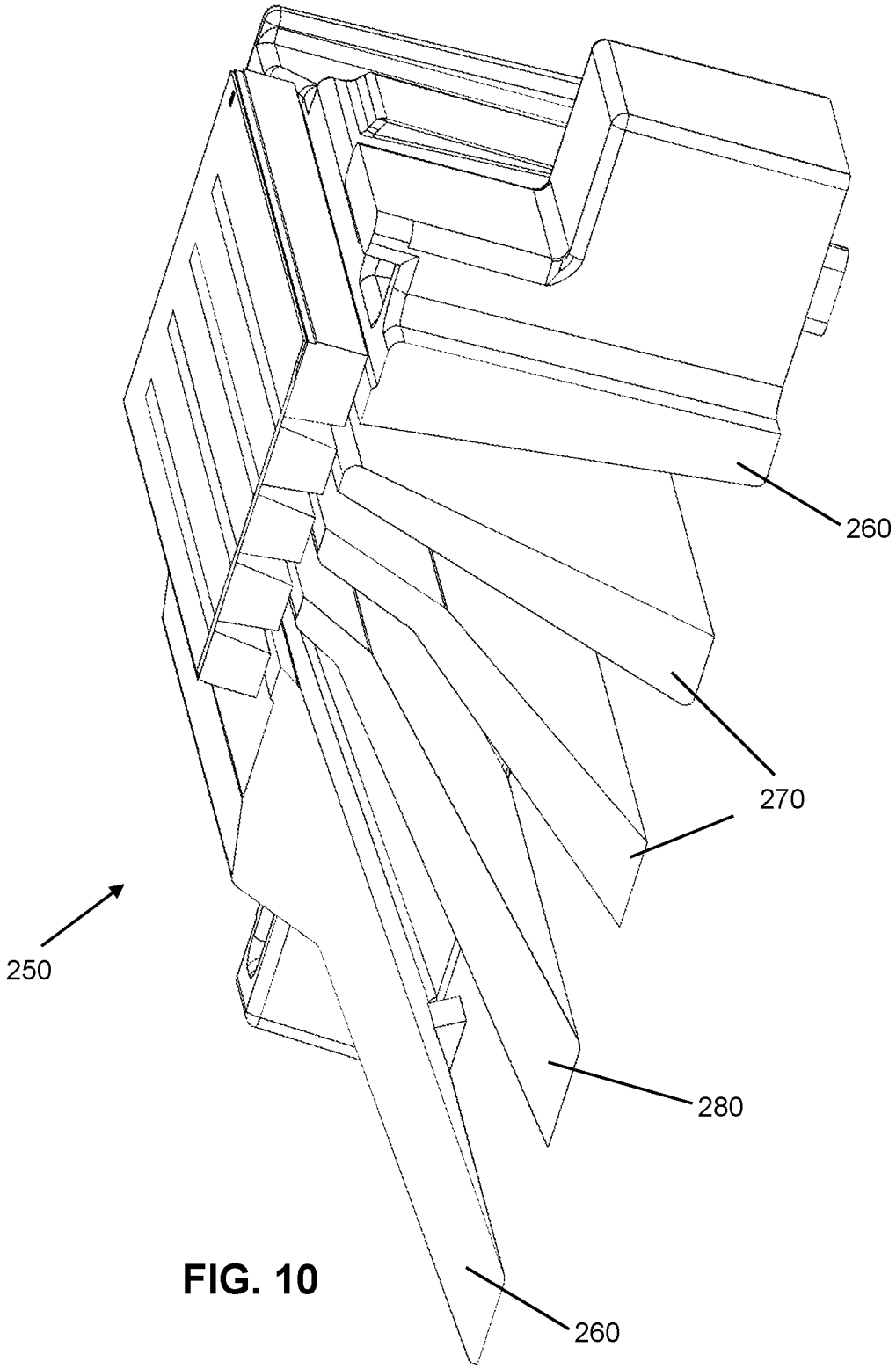
FIGS. 10 and 11 show another printhead subassembly in accordance with other implementations.
Figure 11:
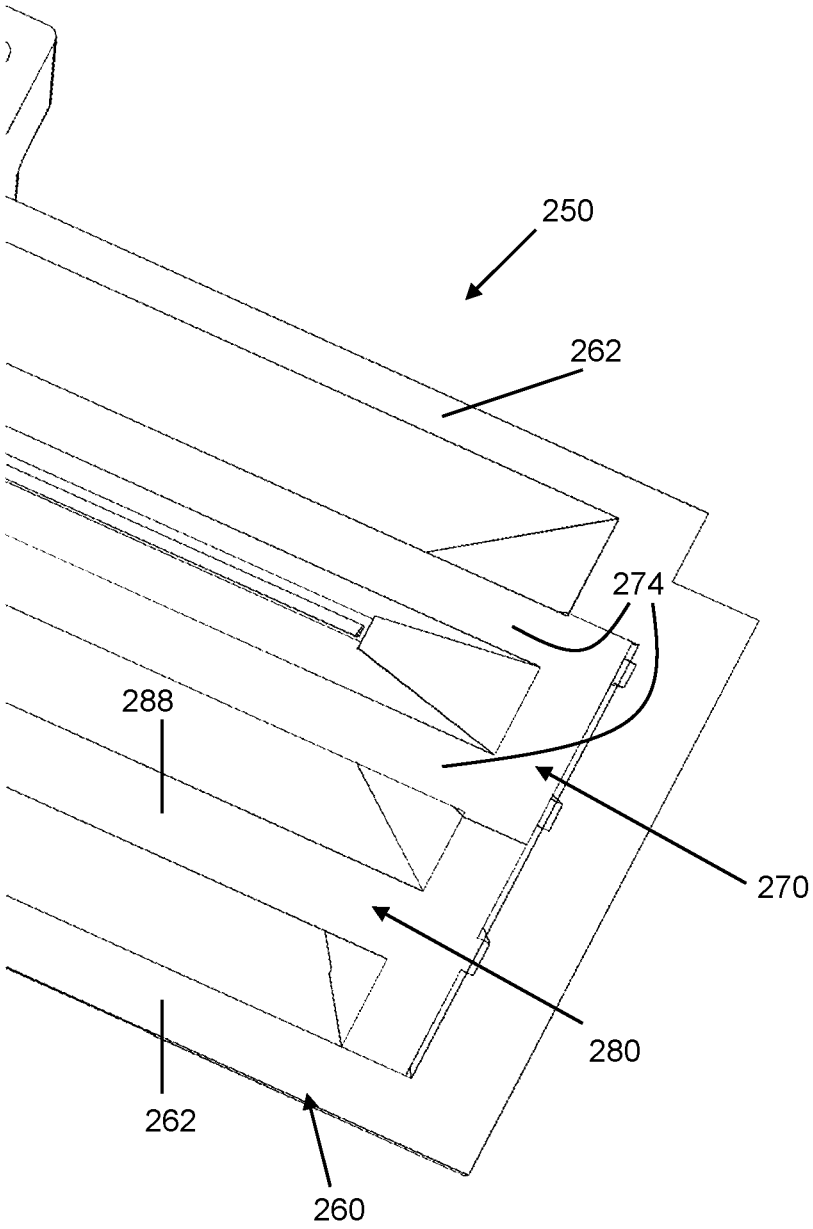

FIGS. 10 and 11 show a different embodiment of a fluid routing assembly 250. The fluid routing assembly 250 shown in FIGS. 10 and 11 comprise three members 260, 270, and 280 but are nested in a different manner than fluid routing assembly 150. For fluid routing assembly 250, members 270 and 280 both are nested within a space defined by outer member 260. Members 270 and 280 reside adjacent one another, rather one such member nested within the other member.

Outer member 260 generally comprises a pair of angled sides 262 (parallel or non-parallel) connected together by way of end caps 264. In some embodiments, outer member 260 is formed as one unitary member, but in other embodiments, outer member 260 may be formed as separate pieces 262 and 264 which are then attached together via, for example, adhesive or welding. The outer member 260 may be formed from plastic or other suitable material (e.g., metal, ceramic).

Member 270 also comprises a pair of angled sides 274 (parallel or non-parallel) connected together by way of end caps 276. In some embodiments, member 270 is formed as one unitary member, but in other embodiments, member 270 may be formed as separate pieces 274 and 276 which are then attached together via, for example, adhesive or welding. The member 270 may be formed from plastic or other suitable material (e.g., metal, ceramic).

In the embodiment of FIGS. 10 and 11 member 280 comprises a single longitudinal bar 288 with end caps 284 on either end of the bar. In some embodiments, inner member 280 is formed as one unitary member, but in other embodiments, inner member 280 may be formed as separate pieces which are then attached together via, for example, adhesive or welding. The inner member 280 may be formed from plastic or other suitable material (e.g., metal, ceramic).

In the embodiment of FIGS. 10 and 11, the members 260, 270, and 280 forming fluid routing assembly 250 are welded together, instead of the use of adhesive. For example, laser welding can be used to attach the members 260, 270, and 280 together.

Figure 12:
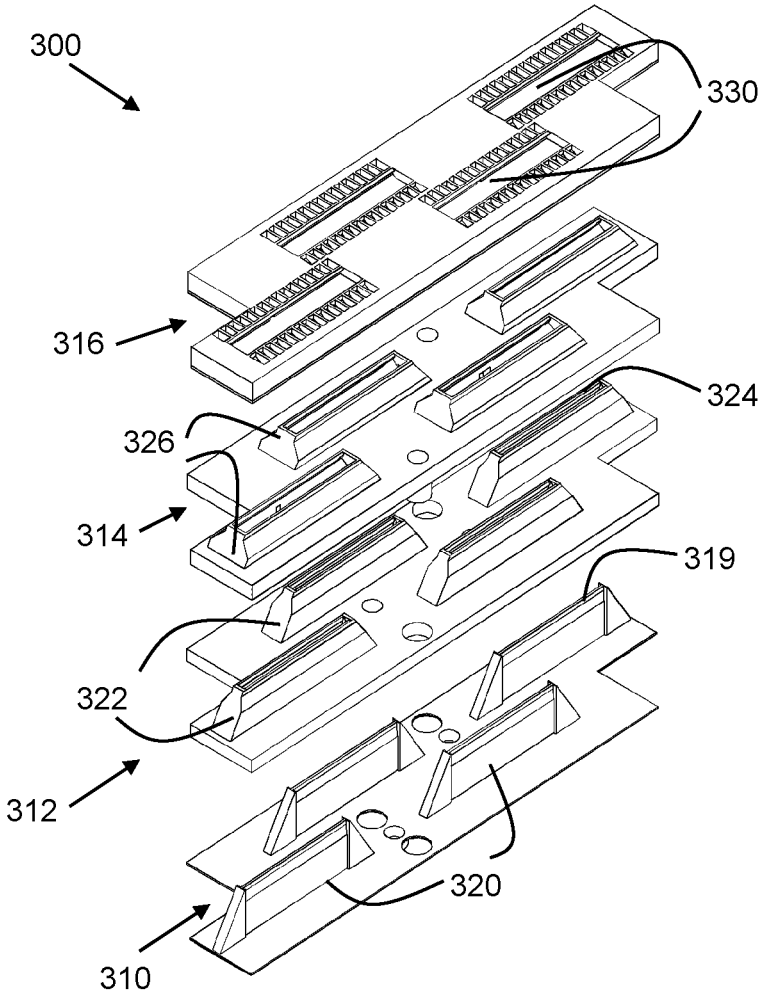
FIGS. 12 and 13 show another implementation of multiple printhead subassemblies formed on a common substrate.
Figure 13:
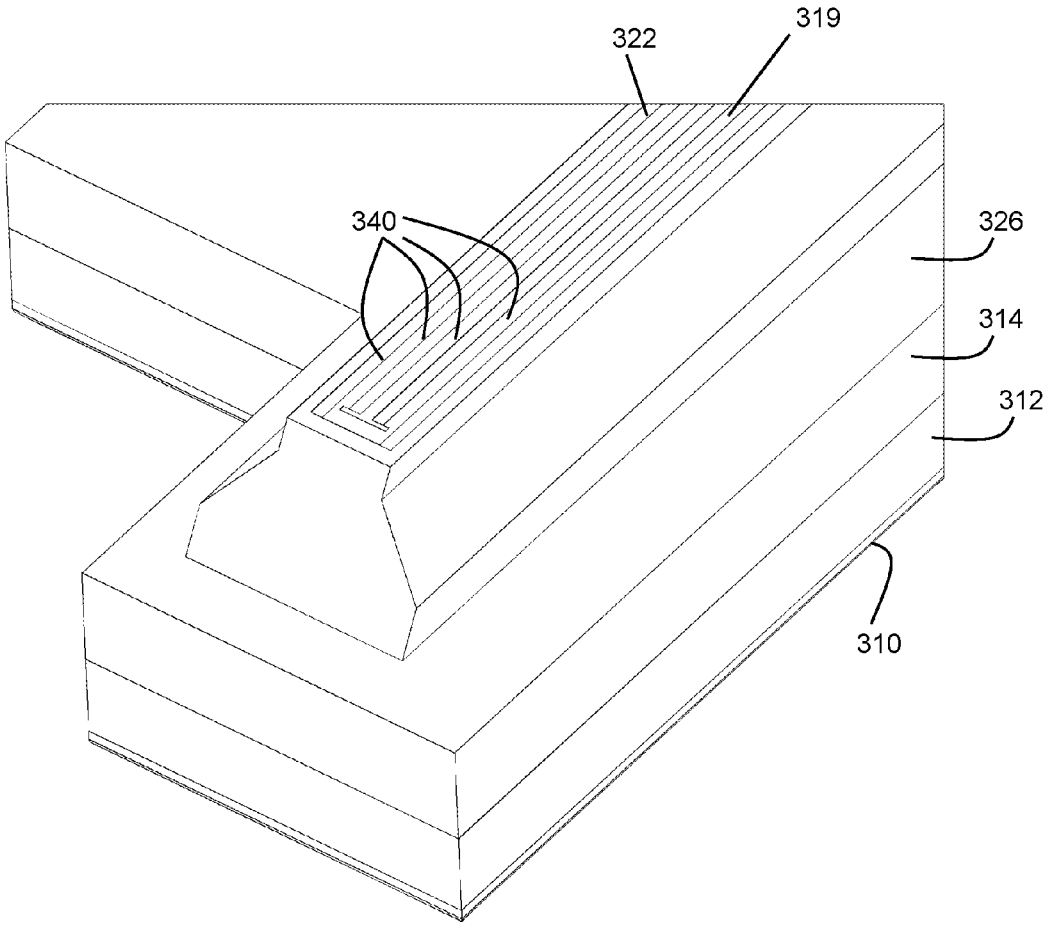

FIGS. 12 and 13 show an embodiment in which multiple fluid routing assemblies 300 are formed on a common substrate. In the embodiment of FIGS. 12 and 13, four fluid routing assemblies are shown on a common substrate. FIG. 12 shows an exploded view. The multi-fluid routing assembly of FIG. 12 comprises parts 310, 312, 314, and 316. Each part 310-316 comprises a substrate on which four features are formed. Part 310, for example, comprises four inner members 320. Each inner member 320 generally comprises a longitudinal bar as shown.

Part 312 comprises four middle members 322 whose length and width dimensions are slightly larger than for inner members 320. Accordingly, parts 312 and 310 can be mated together with four inner members 320 nested within the space defined by the four corresponding middle members 322. Each middle member 322 comprises a slot 324 in its upper end to receive the tips 319 of inner members 320.

Part 314 comprises four outer members 326 whose length and width dimensions are slightly larger than those of middle members 322 thereby permitting the middle members 322 to be nested within the outer members 326. Part 316 is a die carrier on to which a die can be mated. Slots 330 are formed therein to receive the nested members 320, 322 and 326.

FIG. 13 illustrates a portion of the assembled multiple fluid routing assembly 250. By nesting the inner, middle, and outer members 320, 322, and 326 as explained above, four fluidic channels 340 are formed between adjacent members 320, 322 and 326 as noted above in regard to fluid routing assemblies 150 and 250.

Figure 14:
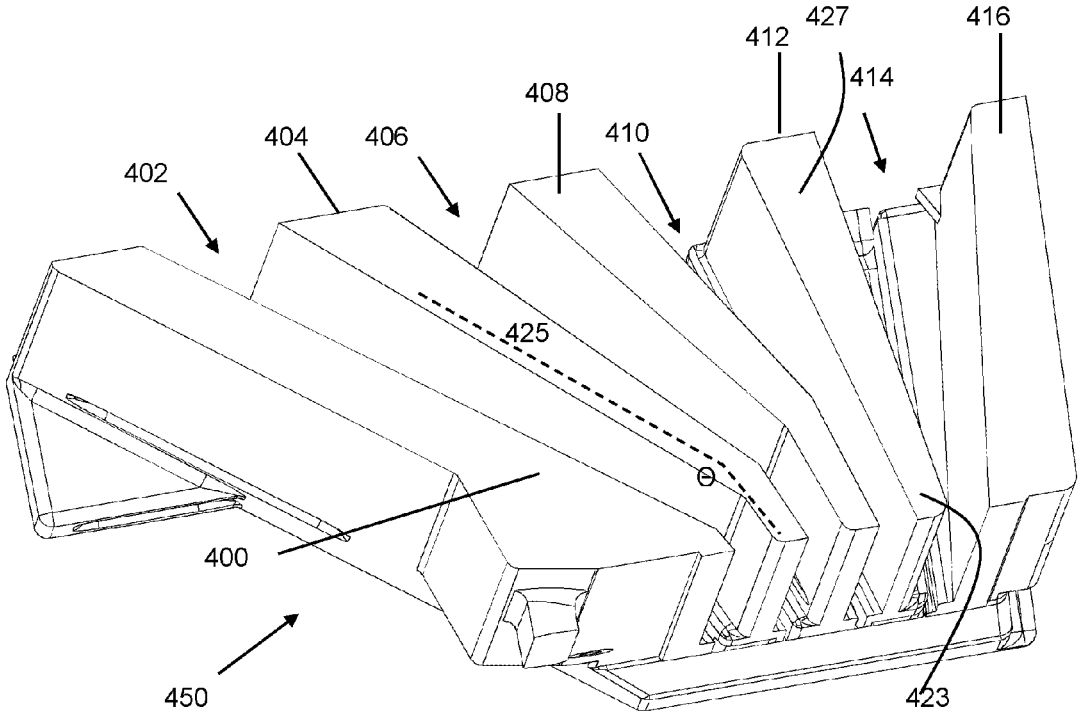
FIG. 14 illustrates an implementation of a printhead subassembly having a non-uniform geometry.

Because the various fluidic transmission channels are not formed through the use of thin blades that are extracted from a single block of molded plastic and instead are formed by the spaces between adjacent separately formed individual members, the fluidic transmission channels can be straight line (linear) passageways or can be of any desired geometry. FIG. 14, for example, illustrates an embodiment of a fluid routing assembly 450 having four fluidic transmission channels 402, 406, 410, and 414 defined by members 400, 404, 408, 412, and 416. Members 400 and 416 may be opposing sides of the same member as explained above. Similarly, members 404 and 412 may also be opposing sides of the same member as explained above.

At least some of the various members are angled along their longitudinal axis. For example member 408 has a longitudinal axis 425 that is angled as shown (angle Θ). Such angles in the members define fluidic transmission channels that also are angled as illustrated by channels 402 and 406. Some of the members also may have a cross-sectional size and/or shape that is non-uniform along its length. For example, member 412 has a smaller cross-sectional area at point 423 than at point 427. As a result, the corresponding fluidic channel 414, 410 also has a cross-sectional shape that is non-uniform.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A printhead, comprising:

a first member; and a second member, formed separately from the first member, nested within a first space defined by the first member;

a die coupled to an outer surface of the printhead; and wherein a plurality of fluidic transmission channels are formed between said first and second members to convey ink to an outer surface of said first and second members.

2. The printhead of claim 1 further comprising a third member nested within a second space defined by the second member, wherein a plurality of fluidic transmission channels is formed between said second and third members to permit ink to be conveyed to said outer surface.

3. The printhead of claim 2 further comprising adhesive that adheres together said first, second, and third members.

4. The printhead of claim 1 further comprising adhesive that adheres together said first and second members, wherein, when dry and adhering said first and second members together, said adhesive comprises a longitudinal portion and a side portion extending from said longitudinal portion.

5. The printhead of claim 1 further comprising a third member nested within said space and adjacent said second member, wherein said plurality of fluidic transmission channels comprises at least one fluidic transmission channel formed between the first and second members and at least one in transmission channel formed between the second and third members.

6. The printhead of claim 5 wherein said first, second, and third members are welded together.

7. The printhead of claim 1 wherein said first and second members are welded together.

8. The printhead of claim 1 wherein the first member comprises a pair of angled sides and further includes end caps connecting said pair of angled sides.

9. The printhead of claim 8 wherein said second member also comprises a pair of angled sides and end caps connecting said pair of angled sides of said second member, wherein a distance between said pair of angled sides of said second member is less than a corresponding distance between said pair of angled sides of said first member.

10. The printhead of claim 9 further comprising a third member that resides within the first space, said third member comprising a single longitudinal bar with end caps on either end of said bar.

11. The printhead of claim 10 wherein said end caps of said bar are triangular shaped.

12. A fluid routing assembly for a printhead, comprising:

a first member; and a second member, formed separately from the first member, nested within a first space defined by the first member; and a third member, formed separately from the first and second members, also nested within the first space;

wherein at least four fluidic transmission channels are defined between pairs of the first, second, and third members.

13. The fluid routing assembly of claim 12 further comprising adhesive that adheres together said first, second, and third members.

14. The fluid routing assembly of claim 12 wherein the first member comprises a pair of angled sides and further includes end caps connecting said pair of angled sides.

15. The fluid routing assembly of claim 12 wherein said second member comprises a pair of angled sides and end caps connecting said pair of angled parallel sides of said second member, wherein a distance between said pair of angled sides of said second member is less than a corresponding distance between a pair of sides of said first member.

16. The fluid routing assembly of claim 12 wherein said third member comprises a single longitudinal bar with end caps on either end of said bar.

17. The fluid routing assembly of claim 12 the first and second members comprise sides at least one of which is angled along a longitudinal axis thereby defining at least one fluidic transmission channel that is angled.

18. A printer, comprising:

a print media tray; and a plurality of printhead subassemblies to emit ink onto print media provided from said print media tray, wherein each printhead subassembly comprises first, second and third members formed separately from each other;

wherein the second member is nested within a first space defined by the first member, and the third member is also nested within the first space defined by the first member; and wherein at least four fluidic routing channels are defined between at least some pairs of the first, second, and third members.

19. The printer of claim 18 wherein the third member is nested within the second member.

* * * * *